US009981783B2

(12) United States Patent
Valley, III et al.

(10) Patent No.: US 9,981,783 B2
(45) Date of Patent: May 29, 2018

(54) METAL CONTAINER WITH SLIDEABLE TOP

(75) Inventors: Joseph P. Valley, III, Roscoe, IL (US); Edward P. Cronin, Brodhead, WI (US)

(73) Assignee: J.L. Clark, Inc., Rockford, IL (US)

( * ) Notice: Subject to any disclaimer, the term of this patent is extended or adjusted under 35 U.S.C. 154(b) by 992 days.

(21) Appl. No.: 13/571,621

(22) Filed: Aug. 10, 2012

(65) Prior Publication Data

US 2013/0037545 A1 Feb. 14, 2013

Related U.S. Application Data

(60) Provisional application No. 61/523,179, filed on Aug. 12, 2011.

(51) Int. Cl.
*B65D 43/20* (2006.01)

(52) U.S. Cl.
CPC .... *B65D 43/20* (2013.01); *B65D 2543/00083* (2013.01); *B65D 2543/00092* (2013.01); *B65D 2543/00101* (2013.01); *B65D 2543/00212* (2013.01); *B65D 2543/00231* (2013.01); *B65D 2543/00277* (2013.01); *B65D 2543/00296* (2013.01); *B65D 2543/00527* (2013.01); *B65D 2543/00546* (2013.01)

(58) Field of Classification Search
CPC ..... B65D 43/20; B65D 2543/00546; B65D 2543/00527; B65D 2543/00296; B65D 2543/00277; B65D 2543/00212; B65D 2543/00101; B65D 2543/00092; B65D 2543/00083; B65D 2543/00231
USPC ..... 220/345.1–345.5, 254.9; 206/533, 540, 206/536
See application file for complete search history.

(56) References Cited

U.S. PATENT DOCUMENTS

| | | | | |
|---|---|---|---|---|
| 2,008,001 | A * | 7/1935 | Burnham | 206/536 |
| 2,133,651 | A * | 10/1938 | Baker | 206/536 |
| 2,289,747 | A * | 7/1942 | Baker | 222/480 |
| 2,490,746 | A | 12/1949 | Carpenter, Jr. | |
| 2,708,026 | A | 5/1955 | Duell | |
| 2,737,311 | A | 3/1956 | Blacher | |
| 3,334,714 | A | 8/1967 | Gordon | |
| 3,362,564 | A | 1/1968 | Mueller | |
| 3,401,993 | A | 9/1968 | Fenkel | |
| 3,527,373 | A | 9/1970 | Giraudet et al. | |
| 3,782,584 | A | 1/1974 | Swenson et al. | |
| 3,942,630 | A | 3/1976 | Phillips | |
| 3,944,105 | A | 3/1976 | Chollet | |
| 4,284,204 | A | 8/1981 | Carey, Jr. | |

(Continued)

FOREIGN PATENT DOCUMENTS

| | | | |
|---|---|---|---|
| JP | 2000309386 A | * | 11/2000 |
| JP | 2010105746 A | * | 5/2010 |

(Continued)

*Primary Examiner* — James N Smalley
(74) *Attorney, Agent, or Firm* — Reinhart Boerner Van Deuren P.C.

(57) ABSTRACT

A metal container having a metal and a metal bottom that slide relative to one another along a sliding axis is provided. The metal container includes a plastic lid insert attached to the metal lid and a plastic bottom insert attached to the metal bottom that operably couple the metal lid to the metal bottom and provide the structures allowing for a relative sliding motion between the metal lid and the metal bottom.

14 Claims, 7 Drawing Sheets

(56) References Cited

U.S. PATENT DOCUMENTS

| | | | | |
|---|---|---|---|---|
| 4,351,165 | A | 9/1982 | Gottsegen et al. | |
| 4,362,255 | A * | 12/1982 | Bond | B65D 75/5877 220/795 |
| 4,440,307 | A * | 4/1984 | Bartels | B65D 7/04 220/4.12 |
| 4,452,373 | A | 6/1984 | Pearce et al. | |
| 4,546,874 | A | 10/1985 | Kirchhan | |
| 4,570,817 | A | 2/1986 | Hambleton et al. | |
| 4,819,829 | A | 4/1989 | Rosten et al. | |
| 4,905,861 | A | 3/1990 | Boxall et al. | |
| 5,069,354 | A | 12/1991 | Tannenbaum | |
| 5,211,302 | A | 5/1993 | Tiramani | |
| D367,211 | S | 2/1996 | Cautereels | |
| 5,611,451 | A | 3/1997 | Mosior et al. | |
| 5,676,272 | A | 10/1997 | Baerenwald | |
| D393,063 | S | 3/1998 | Wefler | |
| 5,782,371 | A | 7/1998 | Baerenwald et al. | |
| 5,794,814 | A | 8/1998 | Baerenwald | |
| 5,855,766 | A | 1/1999 | Mamiye et al. | |
| D407,972 | S | 4/1999 | Hilton | |
| 5,950,816 | A | 9/1999 | Reid | |
| D432,911 | S | 10/2000 | Clarke et al. | |
| D433,940 | S | 11/2000 | Lindsay et al. | |
| 6,210,638 | B1 | 4/2001 | Grieco et al. | |
| 6,341,710 | B1 | 1/2002 | Danielson et al. | |
| 6,457,223 | B1 * | 10/2002 | Breton et al. | 29/417 |
| D465,729 | S | 11/2002 | Nishimura | |
| D478,280 | S | 8/2003 | Miller et al. | |
| D479,462 | S | 9/2003 | Chan | |
| 6,622,895 | B2 * | 9/2003 | McClean et al. | 222/570 |
| 6,772,905 | B2 | 8/2004 | Cheng | |
| D505,089 | S | 5/2005 | Thadani | |
| 6,976,577 | B2 | 12/2005 | Devine | |
| 7,047,576 | B2 | 5/2006 | Tavivian | |
| D527,995 | S | 9/2006 | Tanner | |
| D527,996 | S | 9/2006 | Tanner | |
| D531,023 | S | 10/2006 | Tanner | |
| D534,068 | S | 12/2006 | Tanner | |
| D534,070 | S | 12/2006 | Tanner | |
| D535,184 | S | 1/2007 | Tanner | |
| D535,185 | S | 1/2007 | Tanner | |
| 7,278,545 | B2 * | 10/2007 | Costin et al. | 220/1.6 |
| 7,721,908 | B2 | 5/2010 | Cronin et al. | |
| 7,934,615 | B2 | 5/2011 | Hoffman et al. | |
| 2001/0035424 | A1 | 11/2001 | Combe et al. | |
| 2004/0055903 | A1 | 3/2004 | Nishimura | |
| 2004/0056035 | A1 * | 3/2004 | Baker et al. | 220/345.1 |
| 2004/0188317 | A1 | 9/2004 | Krumme | |
| 2004/0217116 | A1 | 11/2004 | Offerman et al. | |
| 2004/0256346 | A1 * | 12/2004 | Becker | B65D 1/0246 215/44 |
| 2005/0023183 | A1 * | 2/2005 | Banik et al. | 206/581 |
| 2005/0061161 | A1 * | 3/2005 | Hunot et al. | 99/441 |
| 2005/0199527 | A1 | 9/2005 | Ellis et al. | |
| 2005/0286964 | A1 * | 12/2005 | Boulogne | A45D 40/06 401/88 |
| 2007/0246467 | A1 * | 10/2007 | Kneer | 220/254.9 |
| 2008/0035643 | A1 | 2/2008 | Hoffman et al. | |
| 2009/0065390 | A1 | 3/2009 | Oono et al. | |
| 2010/0000993 | A1 | 1/2010 | Cronin | |

FOREIGN PATENT DOCUMENTS

| | | | |
|---|---|---|---|
| JP | 2011-111224 | A | 6/2011 |
| JP | 2011-152926 | A | 8/2011 |
| KR | 20-0316742 | Y1 | 6/2003 |

* cited by examiner

METAL CONTAINER WITH SLIDEABLE TOP

CROSS-REFERENCE TO RELATED PATENT APPLICATIONS

This patent application claims the benefit of U.S. Provisional Patent Application No. 61/523,179, filed Aug. 12, 2011, the entire teachings and disclosure of which are incorporated herein by reference thereto.

FIELD OF THE INVENTION

The present invention generally relates to hand-held containers, and more particularly to hand-held containers that have metal shelves that slide relative to one another.

BACKGROUND OF THE INVENTION

Containers for storing individual pieces of product, such as candies and mints, come in all different shapes, sizes and configurations. While not having a significant effect on many of the contents of the container, consumers generally perceive containers formed from metal as being a higher quality product, which promotes sales thereof. Unfortunately, metals are more difficult to manufacture into containers that are easily opened and closed. For instance, it can be very difficult to form a hinge between a metal lid and a metal bottom of a metal container wherein the metal parts of the container form the hinge. Further, it can be difficult to provide a metal container that has a metal lid that slides axially relative to the metal bottom. This is particularly true, when it is desired to have an outer periphery for the container that is generally smooth and free of interruptions or stepped arrangements.

The present invention relates to improvements over the metal container art. These and other advantages of the invention, as well as additional inventive features, will be apparent from the description of the invention provided herein.

BRIEF SUMMARY OF THE INVENTION

In an embodiment of the present invention, a new and improved metal container having a metal lid slidingly connected to a metal bottom is provided. In a more particular embodiment, the metal lid is operably attached to the metal bottom for sliding action by a plastic lid insert attached to the metal lid, and a plastic bottom insert attached to the metal bottom. The plastic lid insert is slidingly engaged with the plastic bottom insert.

The use of the plastic inserts to provide the sliding engagement between the metal lid and the metal bottom provides for low-cost manufacturability of the structures that axially couple the metal lid to the metal bottom, and further provides for the sliding interaction therebetween.

In a particular embodiment, one of the plastic lid insert and the plastic bottom insert includes a pair of sliding channels extending parallel to the sliding axis and the other one of the plastic lid insert and the plastic bottom includes a pair of sliding lugs that slidingly mate with the sliding channels for limited relative linear motion parallel to the sliding axis. In certain embodiments, the sliding lugs secure the plastic lid insert to the plastic bottom insert.

In a further embodiment, the metal lid is generally circular proximate an interface with the plastic lid insert and further comprising an orientation arrangement between the metal lid and the plastic lid insert. In this embodiment, the metal bottom is generally circular proximate an interface with the plastic bottom insert, which includes an axially-extending bottom flange that is axially received within the metal bottom, the axially-extending bottom flange engaging a radially-inward-formed end portion of a sidewall of the metal bottom to secure the metal bottom to the plastic bottom insert. The orientation arrangement may include a radially-inward-extending orientation tab formed by the metal lid and an orientation notch formed by the plastic lid insert, the orientation notch receiving the orientation tab, the orientation notch and orientation tab configured to allow the metal lid and plastic lid insert to be attached to one another in a limited angular orientation.

Further, the plastic lid insert may include an axially-extending attachment flange that is axially received within the metal lid, the attachment flange axially engaging a radially-inward-formed end portion of a sidewall of the metal lid to secure the metal lid to the plastic lid insert. In a particular embodiment, the axially-extending attachment flange is generally circular and the orientation notch is formed in the attachment flange such that the attachment flange does not form a complete circle. The axially-extending attachment flange may have at least one support rib extending cordwise and intersecting the attachment flange at opposed opposite ends of the at least one support rib.

In certain embodiments, the metal lid is one of rectangular, oval, trapezoidal, hexagonal, and octagonal circular proximate an interface with the plastic lid insert, and wherein the metal bottom is one of rectangular, oval, trapezoidal, hexagonal, and octagonal circular proximate an interface with the plastic bottom insert.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
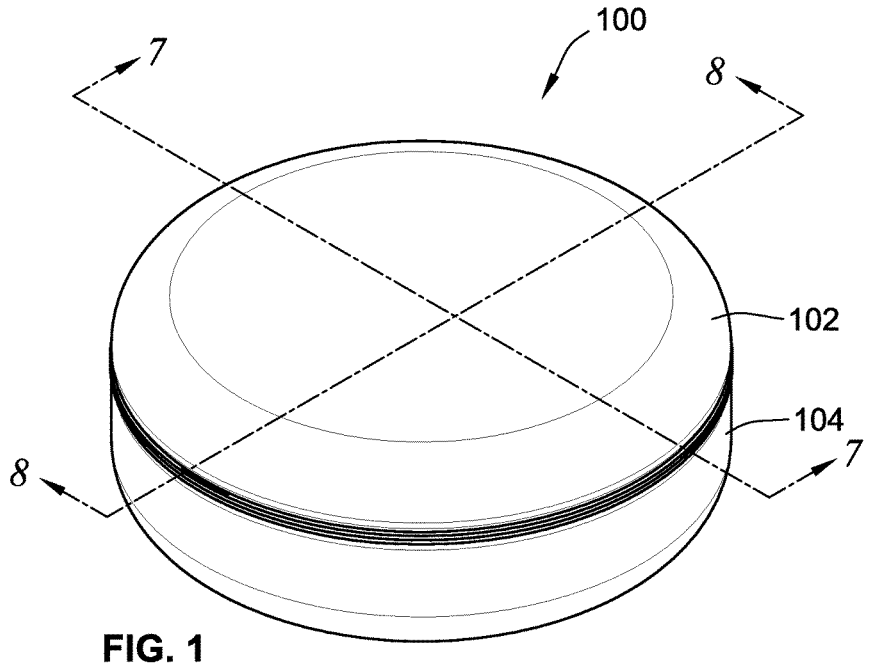
FIG. 1 is a top perspective illustration of a container according to an embodiment of the present invention in a closed state.

FIG. 1 is a top perspective view of a metal container 100 according to an embodiment of the present invention. In particular embodiments, the metal container 100 is used for storing contents therein such as gum, candy, mints or other individual pieces of product that can be commercially sold to consumers. The outer periphery of the metal container 100 is configured such that there are limited interruptions therein and the sides and top and bottom generally transition into one another through smooth curvatures. As such, there are substantially no interruptions in the outer periphery of the metal container 100. The metal container 100 is considered to be substantially metal because the outer surface area of the metal container 100 is at least 90 percent metal and preferably at least 95 percent metal. This percentage of metal does not include any labels that are subsequently attached or printed onto the outer periphery of the metal container 100. While the metal container 100 shown in FIGS. 1-9 are circular, embodiments of the invention described herein would work equally well with containers having shapes other than circular. It is envisioned that embodiments of the invention include containers whose shapes include, but are not limited to, rectangular, trapezoidal, oval, octagonal, and hexagonal.

The metal container 100 includes a metal lid 102 and a metal bottom 104. The metal lid 102 is operably connected to the metal bottom 104 by way of a sliding connection. As such, metal lid 102 is allowed to transition between a closed state (see FIG. 1) and an open state (see FIG. 2). In the closed state, the metal container 100 prevents access to the contents stored therein. In the open state, the user can access the contents stored within the metal container 100.

The difficulties in providing accurate and aesthetically pleasing metal couplings between a metal lid and a metal bottom are overcome by the current embodiment. The metal container 100 utilizes a plastic lid insert 106 that is mechanically snap-fit into the metal lid 102 (see FIG. 3) and a plastic bottom insert 108 that is mechanically snap-fit into the metal bottom 104 (see FIG. 4) to provide the slideable coupling between the metal lid 102 and metal bottom 104. Therefore, the structures required to connect the metal lid 102 to the metal bottom 104, as well as allow the two components to transversely, or axially slide relative to one another along sliding axis 110, are provided by the plastic lid and plastic bottom inserts 106, 108. As such, these structures can be easily and aesthetically pleasingly formed using standard plastic molding processes.

With additional reference to FIGS. 5-8, the features of the components of the metal container 100 will be more fully described.

The metal lid 102 includes a top portion 103 from which a generally annular sidewall 116 extends axially away therefrom. In this context, "axially" means along a central axis (not shown), i.e., a direction perpendicular to the radial direction. The annular sidewall 116 terminates in a radially-inward-directed curled end portion 118. Similarly, the metal bottom 104 includes a bottom portion 120 and an axially-extending annular sidewall 122 extending outward therefrom. The annular sidewall 122 terminates in a radially-inward-directed curled end portion 124.

The curled end portions 118, 124 are used for securing the plastic lid insert and the plastic bottom insert 106, 108 to the corresponding metal lid 102 or metal bottom 104. The plastic lid and plastic bottom inserts 106, 108 include axially-extending attachments 128, 130 that operably engage the curled end portions 118, 124 in a snap-fit engagement to secure the plastic lid insert 106 to the metal lid 102, and to secure the plastic bottom insert 108 to the metal bottom 104. In the illustrated embodiment, each of the axially-extending attachments 128, 130 include a flange that defines a radially-inward-directed groove that radially receives a portion of the respective corresponding curled end portions 118, 124 to provide the axial securement of the metal lid 102 to the plastic lid insert 106, and of the metal bottom 104 to the plastic bottom insert 108.

Figure 5:
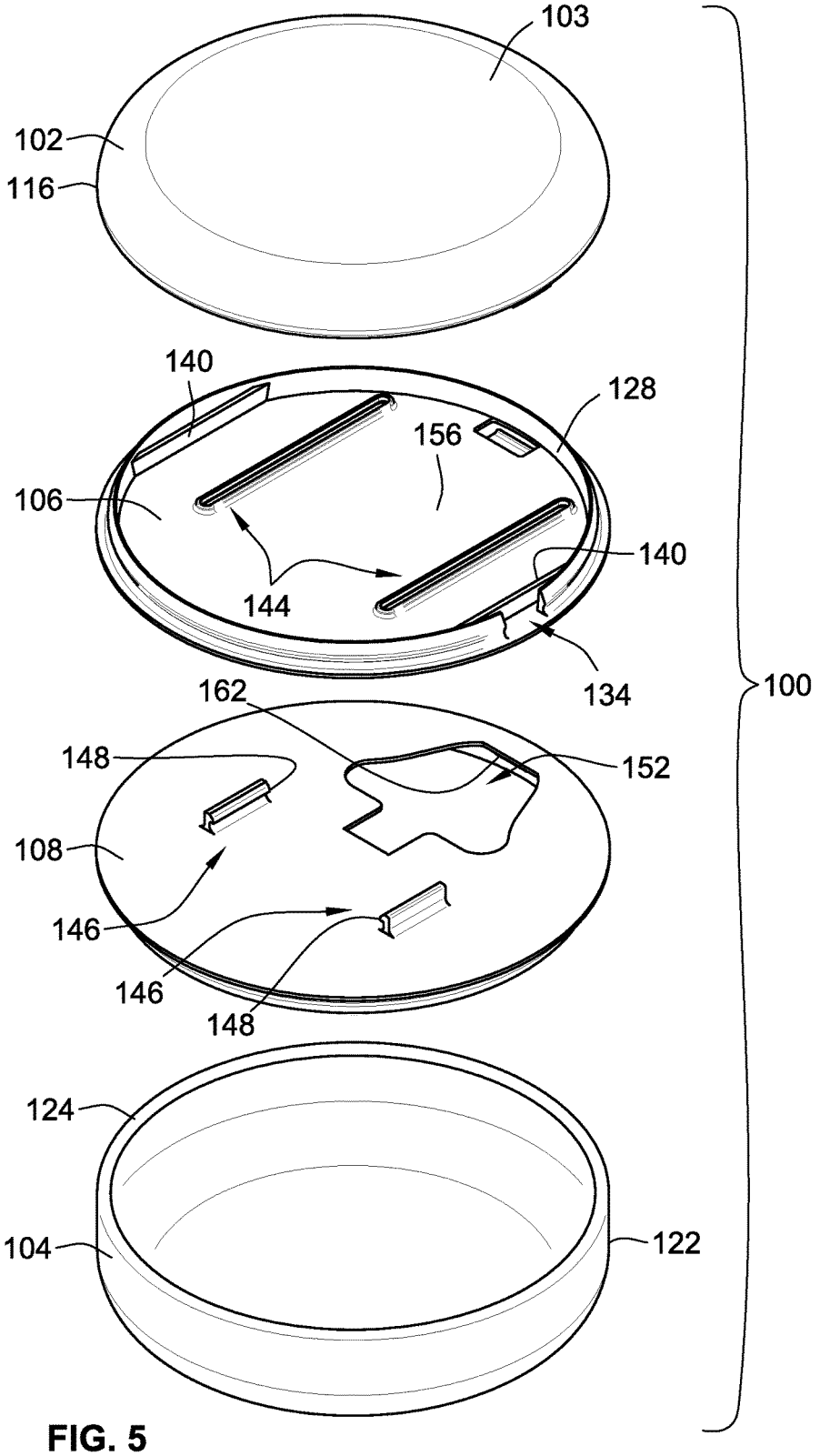
FIG. 5 is a top exploded perspective illustration of the container of FIG. 1.

With reference to FIG. 5, the axially-extending attachment flange 128 of the plastic lid insert 106 is substantially circular except that it includes an orientation notch 134. The orientation notch 134 radially receives an orientation tab 136 (see FIG. 6) that is radially inserted into the orientation notch 134 when the plastic lid insert 106 is snap engaged to the metal lid 102. The engagement or cooperation between the orientation notch 134 and the orientation tab 136 precisely positions the metal lid 102 relative to the plastic lid insert 106. This is particularly beneficial in making sure that any labels or printing on the metal lid 102 are properly oriented with the sliding structures of the container 100 so that they properly align with the sliding axis 110. The flange of the axially-extending attachment 130 of the plastic bottom insert 108 is a continuous annular flange.

Because the flange of the axially-extending attachment 128 for the plastic lid insert 106 includes the orientation notch 134, hoopstrength of the annular flange is reduced. Therefore, the plastic lid insert 106 includes a pair of support ribs 140 that assist in preventing flexure of the plastic lid insert 106. These support ribs 140 extend generally cordwise.

The plastic lid insert 106 and plastic bottom insert 108 provide a sliding interface between the two components. In the illustrated embodiment, the plastic lid insert 106 includes a pair of sliding channels 144. The plastic bottom insert 108 includes a pair of sliding lugs 146 that cooperate with the sliding channels 144 of the plastic lid insert 106. The sliding lugs 146 are snap-engaged into the sliding channels 144 when assembled. The lugs 146 include catch portions that axially engage the portion of the plastic lid insert 106 that bounds the sliding channels 144 such that once the sliding lugs 146 are axially inserted through the sliding channels 144 in a direction extending generally perpendicular to the sliding axis 110, the catch portions 148 prevent axially removing the sliding lugs 146 from the sliding channels 144. Once the sliding lugs 146 are positioned within the sliding channels 144, the sliding lugs 146 are allowed to slide within the sliding channels 144 to transition the metal lid 102 between the open and closed states. In alternate embodiments of the invention, the plastic lid insert 106 could include the sliding lugs 146, and the plastic bottom insert 108 could include the sliding channels 144.

Figure 2:
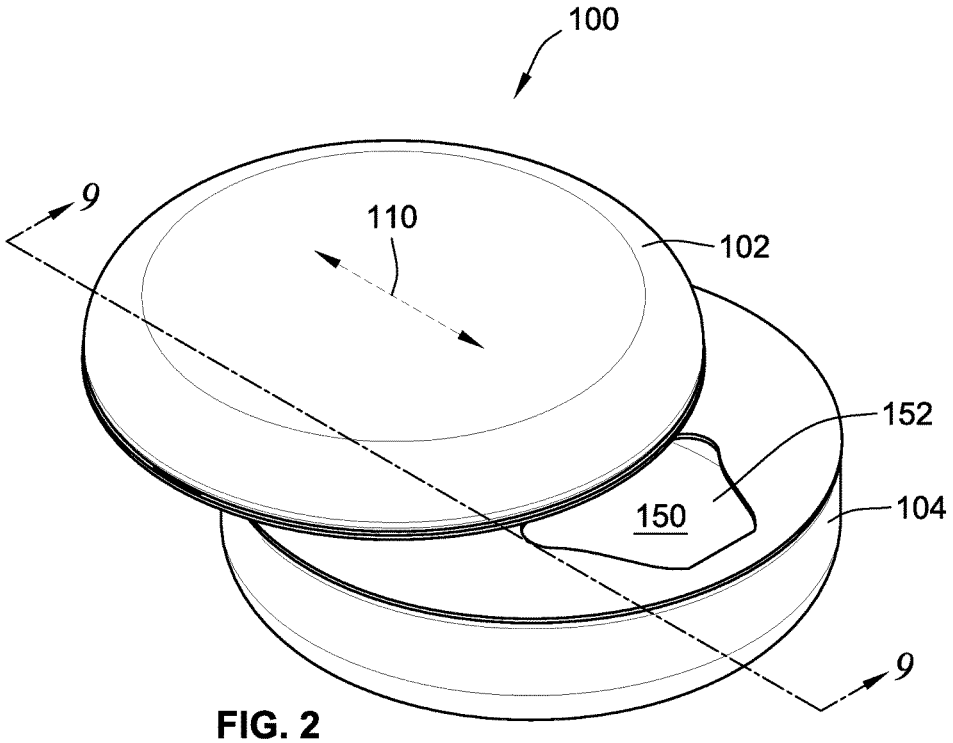
FIG. 2 is a top perspective illustration of the container of FIG. 1 in an open state.
Figure 3:
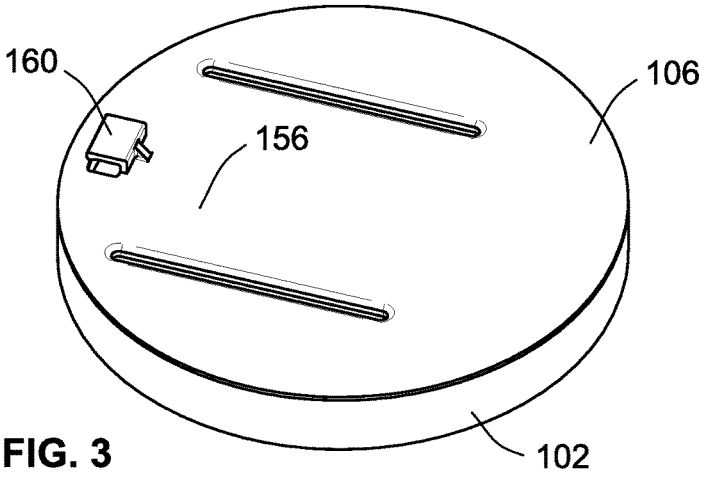
FIG. 3 is a perspective illustration of the lid insert portion of the container of FIG. 1 viewed from a bottom perspective.
Figure 4:
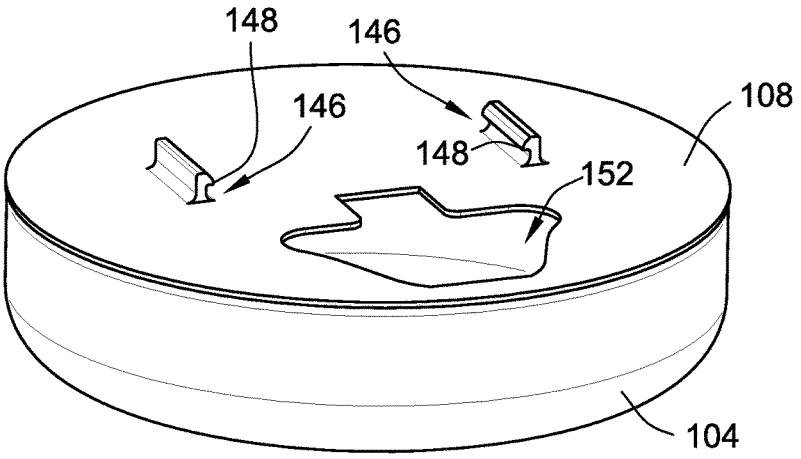
FIG. 4 is a top perspective illustration of a bottom insert portion of the container of FIG. 1.
Figure 7:
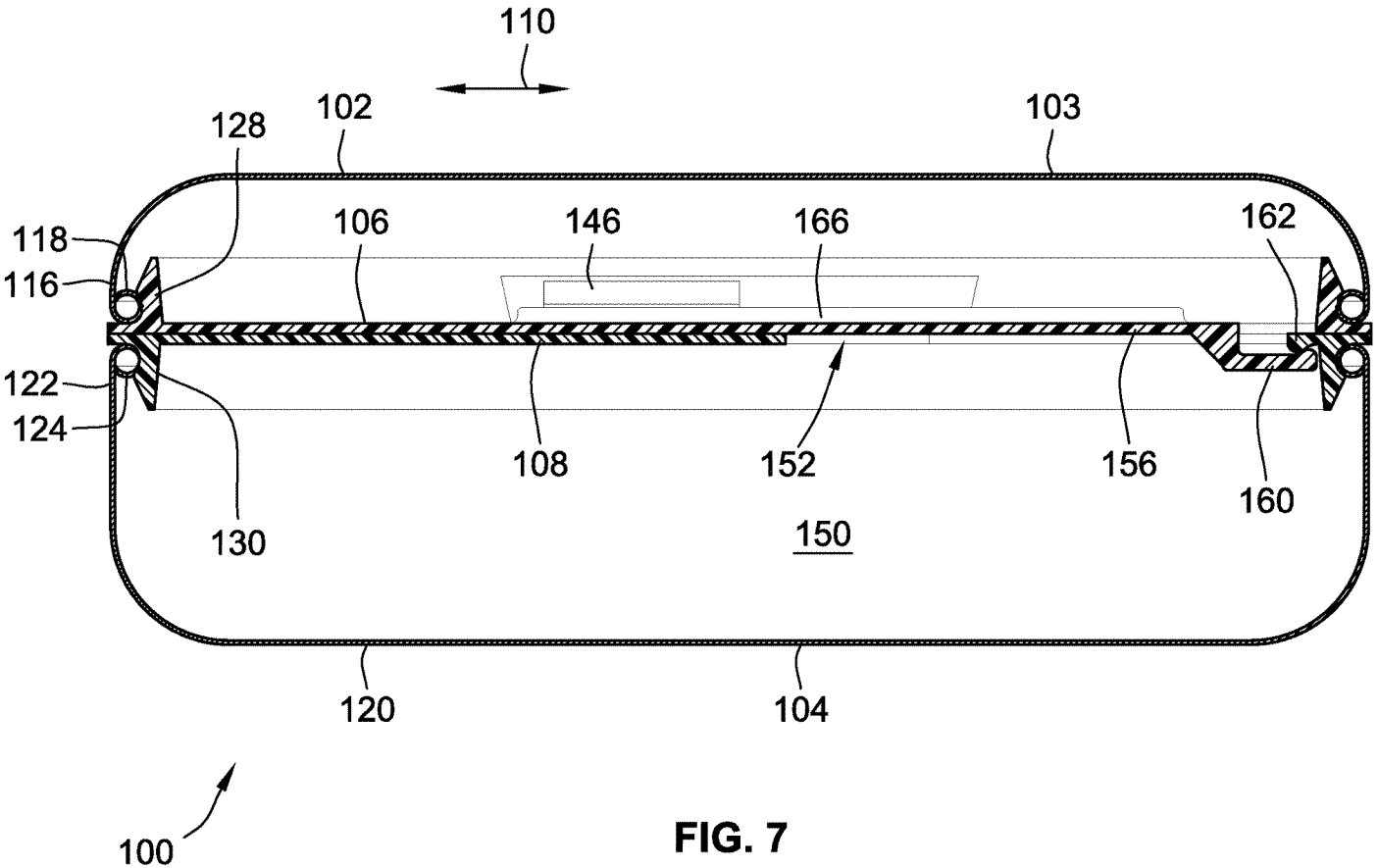
FIG. 7 is a first cross-sectional illustration of the container of FIG. 1 taken about line 7-7.
Figure 8:
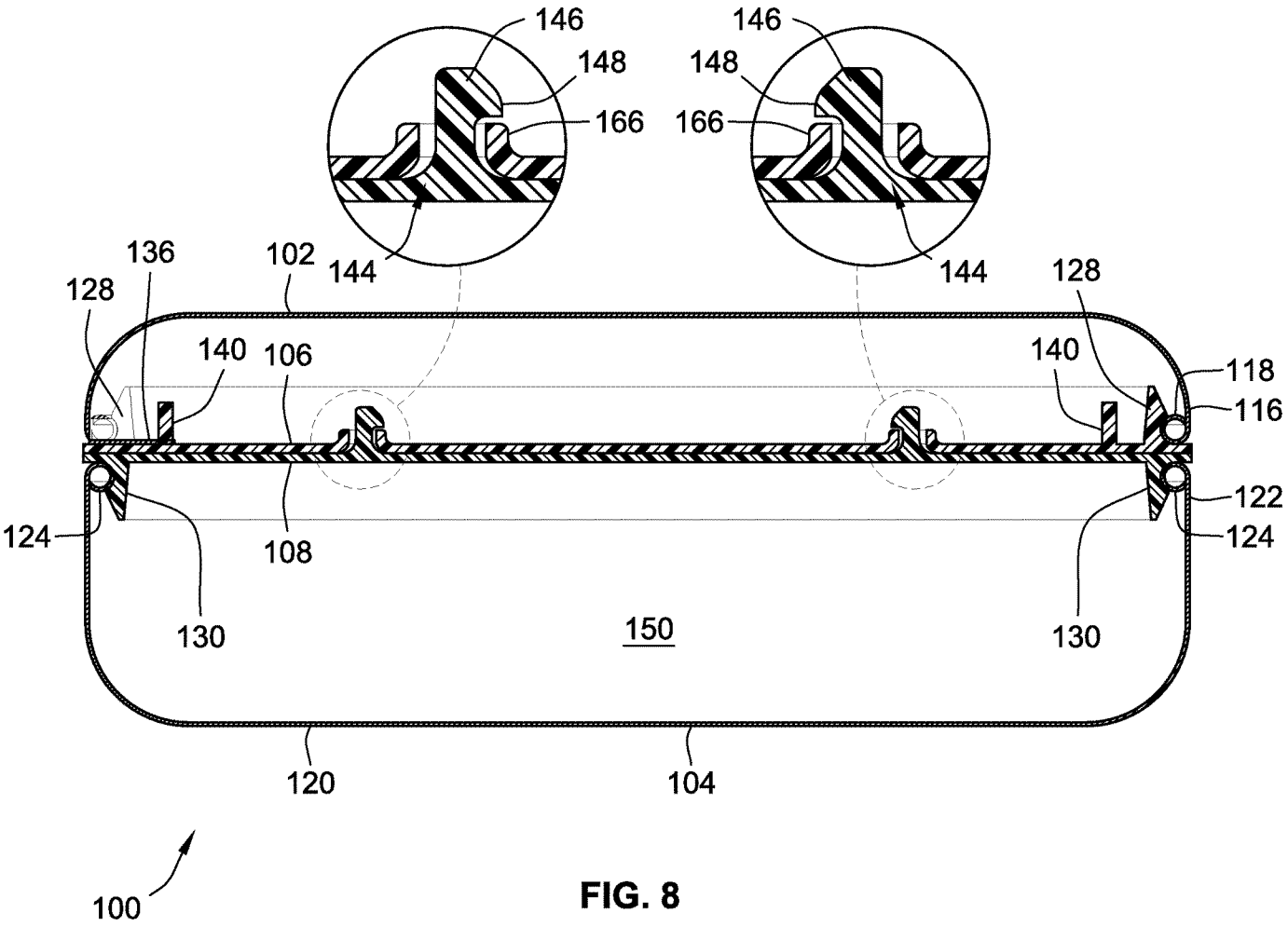
FIG. 8 is a second cross-sectional illustration of the container of FIG. 1 taken about line 8-8.
Figure 9:
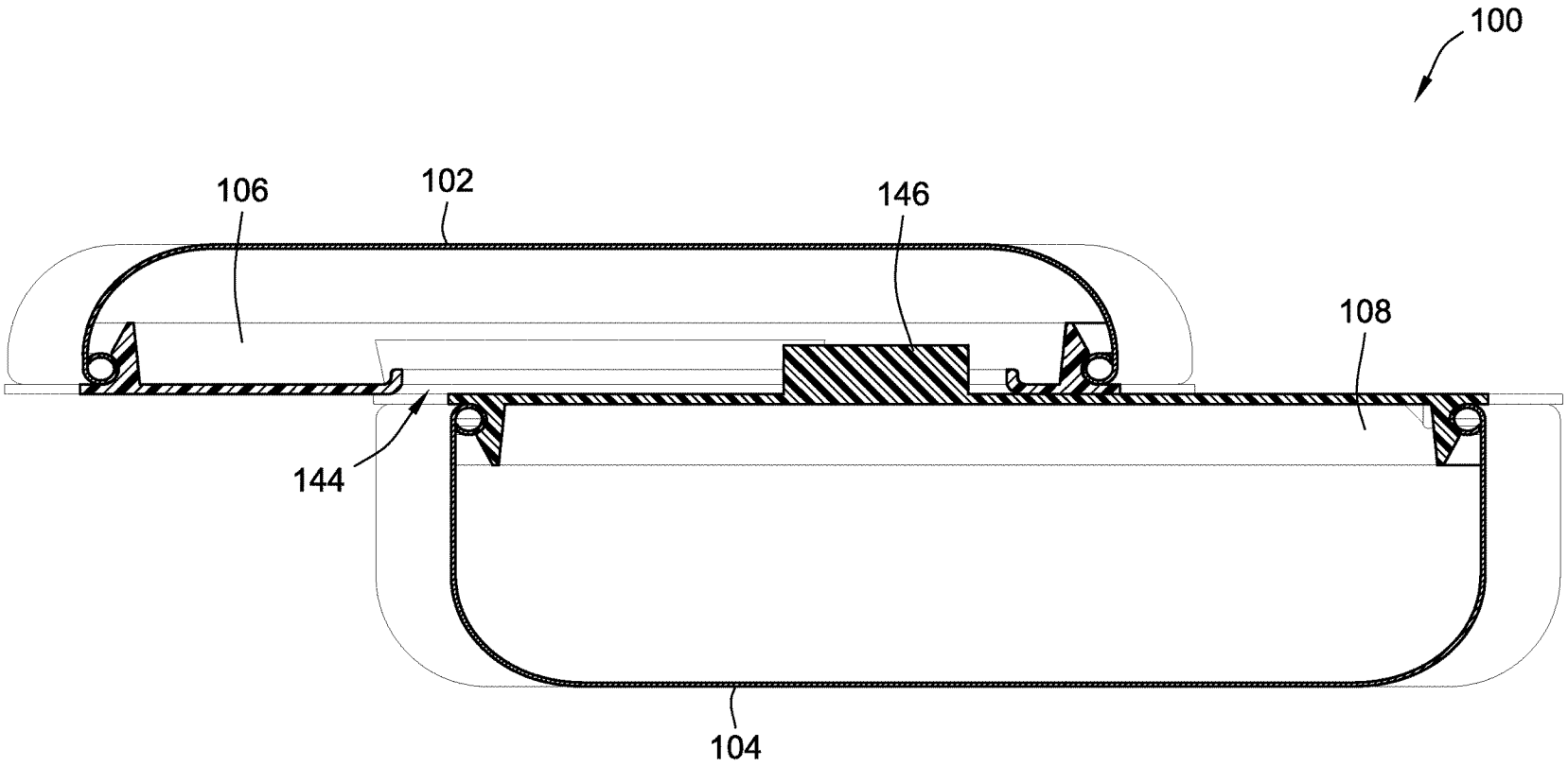
FIG. 9 is a cross-sectional illustration of the container of FIG. 1 in the open state.

When the plastic bottom insert 108 is snap engaged onto the metal bottom insert 108 (as shown in FIGS. 7 and 8), a storage cavity 150 is defined between a bottom surface of the plastic bottom insert 108 and the metal bottom 104. The product stored within the metal container 100 is generally stored within this storage cavity 150. To provide access to the product, the plastic bottom insert 108 includes a dispensing opening 152 that provides access to the storage cavity 150. As illustrated in FIG. 1, in the closed state, the metal lid 102 covers the dispensing opening 152 such that products cannot be removed from the metal container 100. However, as illustrated in FIG. 2, when the metal lid 102 has slid to the open state, the dispensing opening 152 is exposed such that products stored therein can be accessed.

Figure 6:
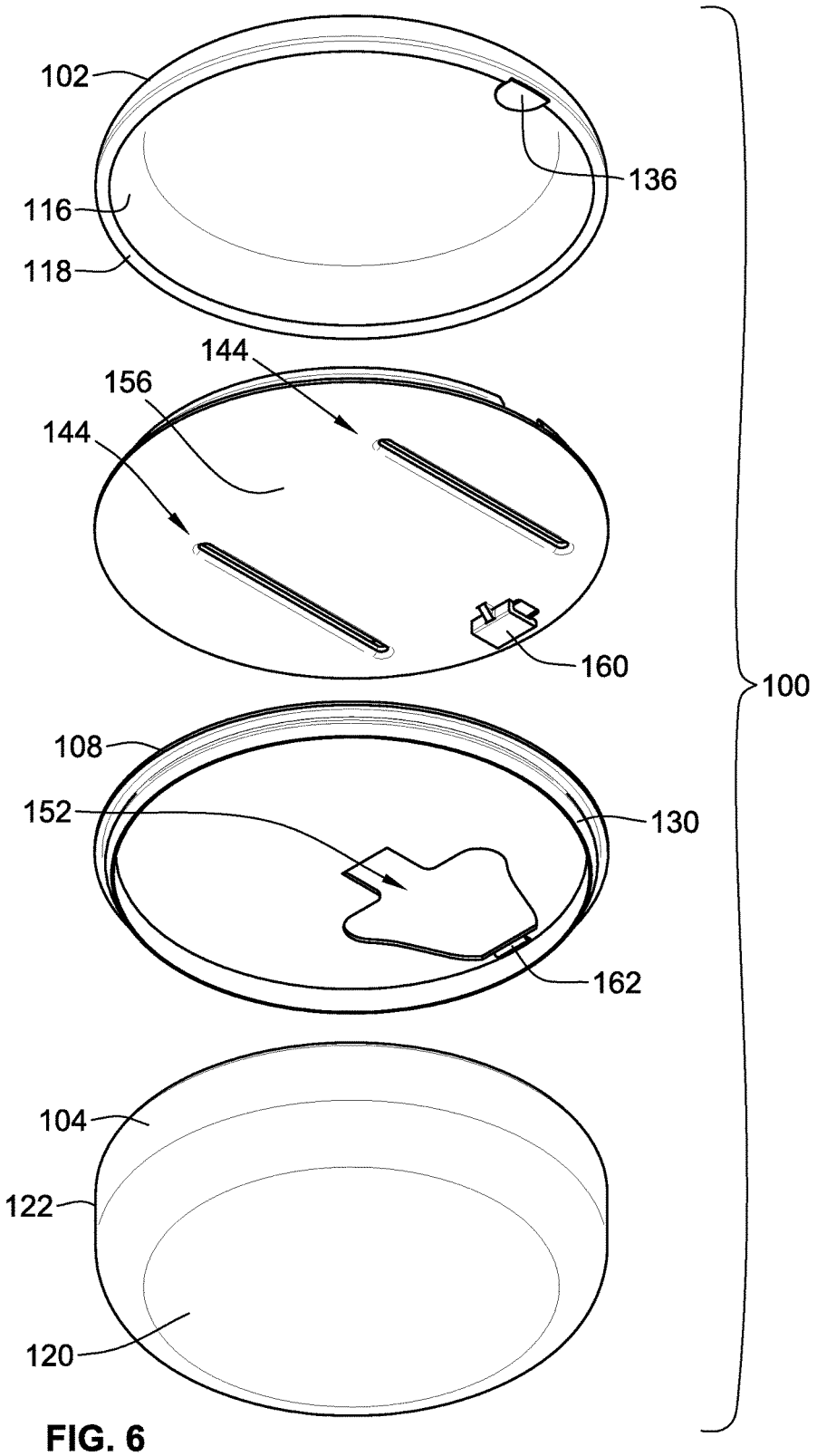
FIG. 6 is a bottom exploded perspective illustration of the container of FIG. 1.

With reference to FIGS. 5 and 6, the plastic lid insert 106 generally includes a generally imperforate section 156 that aligns with the dispensing opening 152 when the metal container 100 is in the closed state. This generally imperforate section 156 is configured to prevent product stored within the storage cavity from getting trapped between the metal lid 102 and the plastic lid insert 106. As used herein, "generally imperforate shell" means something sized to prevent the product stored therein from passing therethrough.

The metal container 100 includes a lock arrangement used to lock the metal container 100 in the closed state. The lock arrangement of the illustrated embodiment is provided by a locking catch 160 on the plastic lid insert 106, wherein the locking catch 160 is axially offset from the generally imperforate section 156 forming an axial gap therebetween. The lock arrangement also includes an axially-extending rib 162 that extends from a portion of the plastic bottom insert 108. The locking catch 160 cooperates with the axially-extending rib 162 to inhibit sliding of the metal lid 102 along the sliding axis 110 towards the open state. However, the engagement is limited such that the user can transition the metal lid 102 to the open state.

With reference to FIGS. 5 and 8, the portion of the plastic lid insert 106 adjacent to the sliding channels 144 forms axially-extending inner ribs 166 that are axially proud of the imperforate section 156 of the plastic lid insert 106. This additional thickness provided by this ribbed arrangement assists in providing additional rigidity and support to the plastic lid insert 106. This ribbed arrangement is best illustrated in FIG. 8. The catch portions 148 of the sliding lugs 146 extend laterally over distal ends of the inner ribs 166 mounting the sliding channels 144. This arrangement, once again, is used to axially secure the metal lid 102 to the metal bottom 104.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

In a further embodiment, the container includes a locking arrangement between the plastic lid insert and the plastic bottom insert to releasably fix the metal lid relative to the metal bottom in the closed state.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a metal lid;

a metal bottom;

a plastic lid insert attached to the metal lid;

a plastic bottom insert attached to the metal bottom, the plastic lid insert slidably engaging the plastic bottom insert to allow the metal lid to slide relative to the metal bottom between open and closed states along a sliding axis.

2. The container of claim 1, wherein one of the plastic lid insert and the plastic bottom insert includes a pair of sliding channels extending parallel to the sliding axis and the other one of the plastic lid insert and the plastic bottom includes a pair of sliding lugs that slidingly mate with the sliding channels for limited relative linear motion parallel to the sliding axis.

3. The container of claim 2, wherein the sliding lugs secure the plastic lid insert to the plastic bottom insert.

4. The container of claim 1, wherein the metal lid is generally circular proximate an interface with the plastic lid insert and further comprising an orientation arrangement between the metal lid and the plastic lid insert.

5. The container of claim 4, wherein the orientation arrangement includes a radially-inward-extending orientation tab formed by the metal lid and an orientation notch formed by the plastic lid insert, the orientation notch receiving the orientation tab, the orientation notch and orientation tab configured to allow the metal lid and plastic lid insert to be attached to one another in a limited angular orientation.

6. The container of claim 5, wherein the plastic lid insert includes an axially-extending attachment flange that is axially received within the metal lid, the attachment flange axially engaging a radially-inward-formed end portion of a sidewall of the metal lid to secure the metal lid to the plastic lid insert.

7. The container of claim 6, wherein the axially-extending attachment flange is generally circular and the orientation notch is formed in the attachment flange such that the attachment flange does not form a complete circle.

8. The container of claim 7, further comprising at least one support rib extending cordwise and intersecting the attachment flange at opposed opposite ends of the at least one support rib.

9. The container of claim 1, further comprising a locking arrangement between the plastic lid insert and the plastic bottom insert to releasably fix the metal lid relative to the metal bottom in the closed state.

10. The container of claim 1, wherein an outer periphery of the container, when in the closed state, is at least 90 percent provided by the metal lid and the metal bottom.

11. The container of claim 1, wherein an outer periphery of the container, when in the closed state, is at least 95 percent provided by the metal lid and the metal bottom.

12. The container of claim 1, wherein the plastic bottom insert and the metal bottom define a storage cavity therebetween, the plastic bottom insert defining a dispensing opening providing access to the storage cavity, the plastic lid insert including a generally imperforate section configured to cover the dispensing opening in the closed state.

13. The container of claim 1, wherein the metal bottom is generally circular proximate an interface with the plastic bottom insert, which includes an axially-extending bottom flange that is axially received within the metal bottom, the axially-extending bottom flange engaging a radially-inward-formed end portion of a sidewall of the metal bottom to secure the metal bottom to the plastic bottom insert.

14. The container of claim 1, wherein the metal lid is one of rectangular, oval, trapezoidal, hexagonal, and octagonal circular proximate an interface with the plastic lid insert, and wherein the metal bottom is one of rectangular, oval, trapezoidal, hexagonal, and octagonal circular proximate an interface with the plastic bottom insert.

* * * * *